US009033424B2

(12) United States Patent
McCormick et al.

(10) Patent No.: US 9,033,424 B2
(45) Date of Patent: May 19, 2015

(54) WEAR RESISTANT CUTTING TOOL

(75) Inventors: Michael R. McCormick, Greensburg, PA (US); Chad A. Swope, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 75 days.

(21) Appl. No.: 13/494,284

(22) Filed: Jun. 12, 2012

(65) Prior Publication Data

US 2013/0328379 A1 Dec. 12, 2013

(51) Int. Cl.

| | |
|---|---|
| ***E21C 35/183*** | (2006.01) |
| ***B28D 1/18*** | (2006.01) |
| *E21C 35/18* | (2006.01) |

(52) U.S. Cl.

CPC ..... *B28D 1/188* (2013.01); *E21C 2035/1816* (2013.01); *E21C 35/183* (2013.01)

(58) Field of Classification Search

CPC ..... E21C 25/10; E21C 35/183; E21C 2035/1816; B28D 1/188; B22F 2998/00

USPC ..... 299/79.1, 101, 105, 106, 108, 109, 110, 299/111, 113

See application file for complete search history.

(56) References Cited

U.S. PATENT DOCUMENTS

| | | | | |
|---|---|---|---|---|
| 3,622,206 | A * | 11/1971 | Krekeler | 299/109 |
| 3,833,264 | A * | 9/1974 | Elders | 299/110 |
| 4,063,909 | A | 12/1977 | Mitchell | |
| 4,604,106 | A | 8/1986 | Hall | |
| 4,694,918 | A | 9/1987 | Hall | |
| 4,811,801 | A | 3/1989 | Salesky et al. | |
| 5,094,923 | A | 3/1992 | Materkowski | |
| 5,279,902 | A | 1/1994 | Materkowski | |
| 6,059,054 | A * | 5/2000 | Portwood et al. | 175/430 |
| 2010/0194176 | A1 | 8/2010 | Lucek et al. | |

OTHER PUBLICATIONS

Kennametal Inc., "KenCast" Product Literature, pp. 1-16, 2003 USA.

* cited by examiner

*Primary Examiner* — John Kreck

*Assistant Examiner* — Carib Oquendo

(74) *Attorney, Agent, or Firm* — Matthew W. Smith

(57) ABSTRACT

A cutting tool includes a cutting tool body having an axial forward end, an axial rearward end, a head portion adjacent the axial forward end and a shank portion adjacent the axial rearward end. The head portion includes a partial frusto-conical portion having a first lateral edge and a second lateral edge; a first side surface having a first lateral transition edge and a first terminal edge, wherein the first lateral transition edge is adjoined to the first lateral edge of the partial frusto-conical portion; and a second side surface having a second lateral transition edge and a second terminal edge, wherein the second lateral transition edge is adjoined to the second lateral edge of the partial frusto-conical portion, and wherein the first terminal edge is adjoined to the second terminal edge to form a cutting edge. The cutting tool also includes a hard cutting tip.

15 Claims, 4 Drawing Sheets

WEAR RESISTANT CUTTING TOOL

BACKGROUND OF THE INVENTION

The invention pertains generally to a wear resistant cutting tool that is useful for the impingement of a substrate or earth strata such as, for example, asphaltic roadway material, coal deposits, mineral formations and the like.

A cutting tool typically presents a generally elongate, cylindrical geometry. The cutting tool comprises an elongate steel cutting tool body, which has an axially forward end and an opposite axially rearward end. A hard cutting member typically affixes to the axial forward end of the cutting tool body. The cutting tool body typically carries an assembly or means by which the cutting tool is rotatable and carried by a stationary block or holder on a drum. Alternatively, the cutting tool can be non-rotatable, i.e. fixed in place, within the block or holder on a drum.

During operation such as, for example, in a road planning application or a mining application, the holder or block carrying the cutting tool is driven forward to impinge the earth strata thereby breaking or disintegrating the earth strata. As can be appreciated, severe forces are exerted on the cutting tools and especially on the cutting tool bodies and hard cutting members. It is thus important that the cutting tool body and the hard cutting members possess optimum properties suitable to withstand such a severe operating environment for an acceptable duration.

Thus, it can be appreciated that cutting tools can experience wear in a number of ways due to the environment in which they operate and must be frequently replaced. It would thus be highly desirable to provide an improved cutting tool that experiences an increase in useful tool life as compared to heretofore known cutting tools.

SUMMARY OF THE INVENTION

In accordance with an aspect of the invention, a cutting tool for use in impinging earth strata includes a cutting tool body having an axial forward end, an axial rearward end, a head portion adjacent the axial forward end and a shank portion adjacent the axial rearward end. The head portion includes a partial frusto-conical portion having a first lateral edge and a second lateral edge. The head portion also includes a first side surface having a first lateral transition edge and a first terminal edge, wherein the first lateral transition edge is adjoined to the first lateral edge of the partial frusto-conical portion. The head portion further includes a second side surface having a second lateral transition edge and a second terminal edge, wherein the second lateral transition edge is adjoined to the second lateral edge of the partial frusto-conical portion, and wherein the first terminal edge is adjoined to the second terminal edge to form a cutting edge. The cutting tool also includes a hard cutting tip affixed to the axial forward end of the cutting tool body.

In accordance with another aspect of the invention, a cutting tool for use in impinging earth strata includes a cutting tool body having an axial forward end, an axial rearward end, a head portion adjacent the axial forward end and a shank portion adjacent the axial rearward end. The cutting tool also includes a hard cutting tip affixed to the axial forward end of the cutting tool body. The hard cutting tip includes a partial frusto-conical tip portion having a first lateral tip edge and a tip second lateral tip edge. The hard cutting tip also includes a first side tip surface having a first lateral transition tip edge and a first terminal tip edge, wherein the first lateral transition tip edge is adjoined to the first lateral tip edge of the partial frusto-conical tip portion. The hard cutting tip also includes a second side tip surface having a second lateral transition tip edge and a second terminal tip edge, wherein the second lateral transition tip edge is adjoined to the second lateral tip edge of the partial frusto-conical tip portion, and wherein the first terminal tip edge is adjoined to the second terminal tip edge to form a tip cutting edge.

These and other aspects of the present invention will be more fully understood following a review of this specification and drawings.

DETAILED DESCRIPTION

Figure 1:
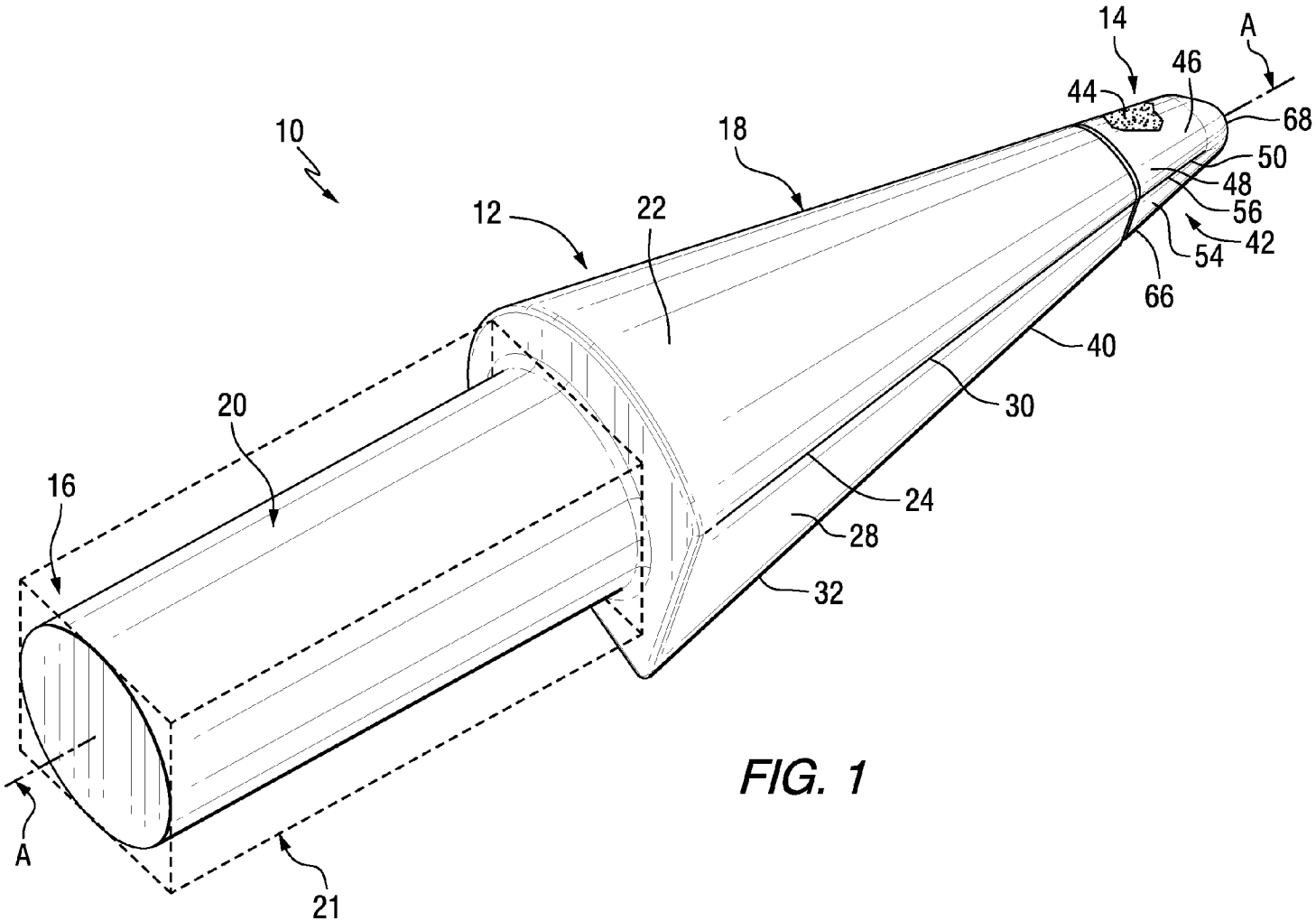
FIG. 1 is an isometric view of a cutting tool, in accordance with an aspect of the invention.
Figure 2:
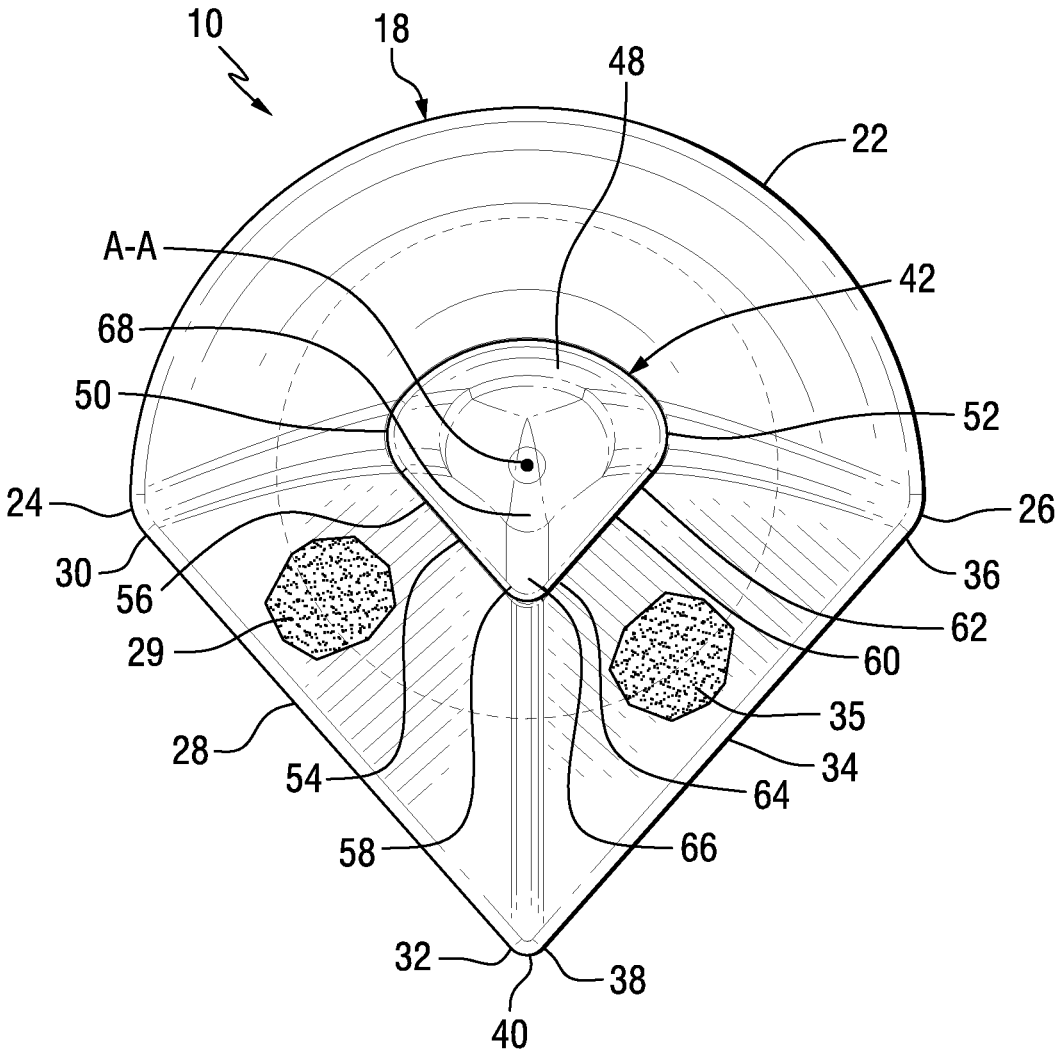
FIG. 2 is a front view of the cutting tool shown in FIG. 1, in accordance with an aspect of the invention.
Figure 3:
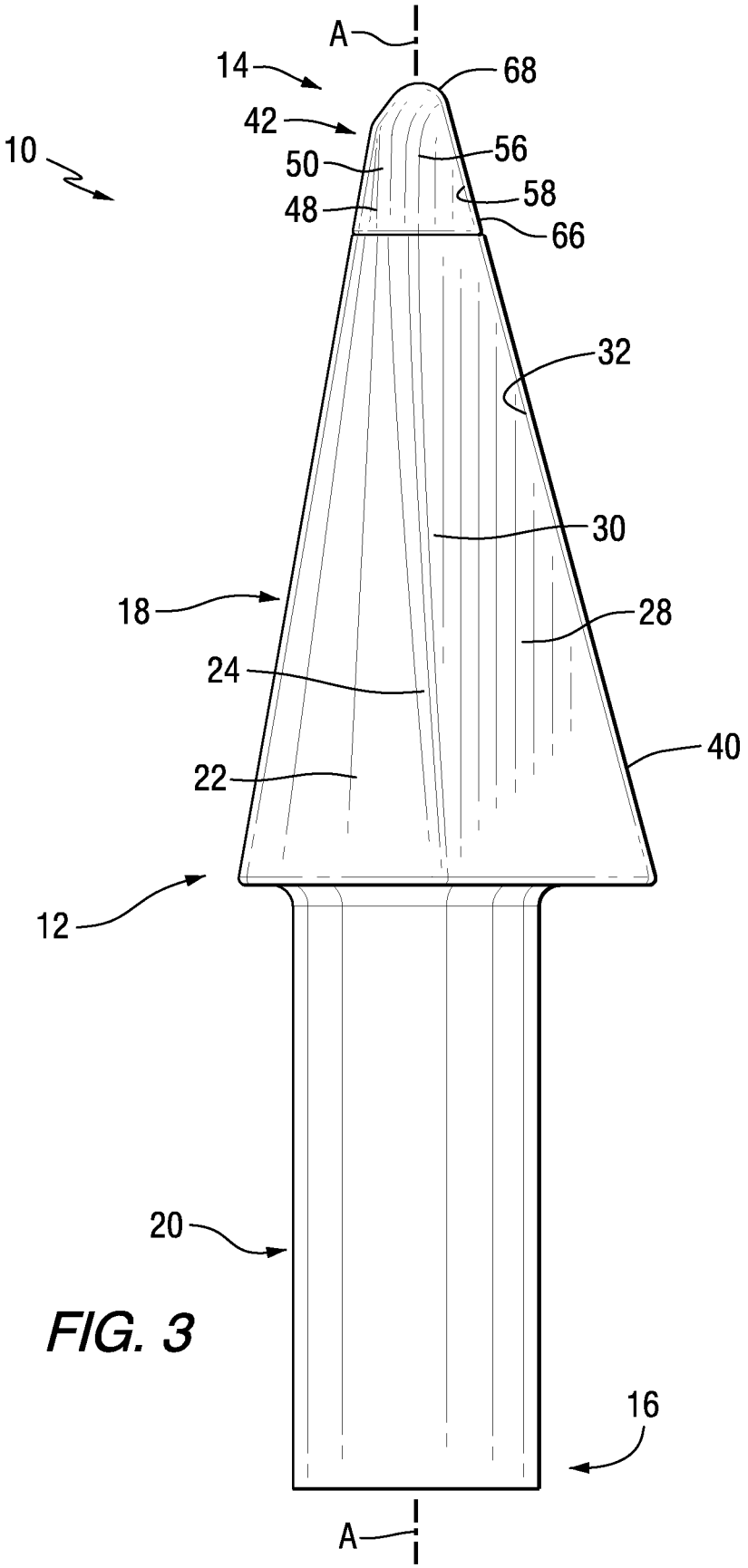
FIG. 3 is a side view of the cutting tool shown in FIGS. 1-2, in accordance with an aspect of the invention.
Figure 4:
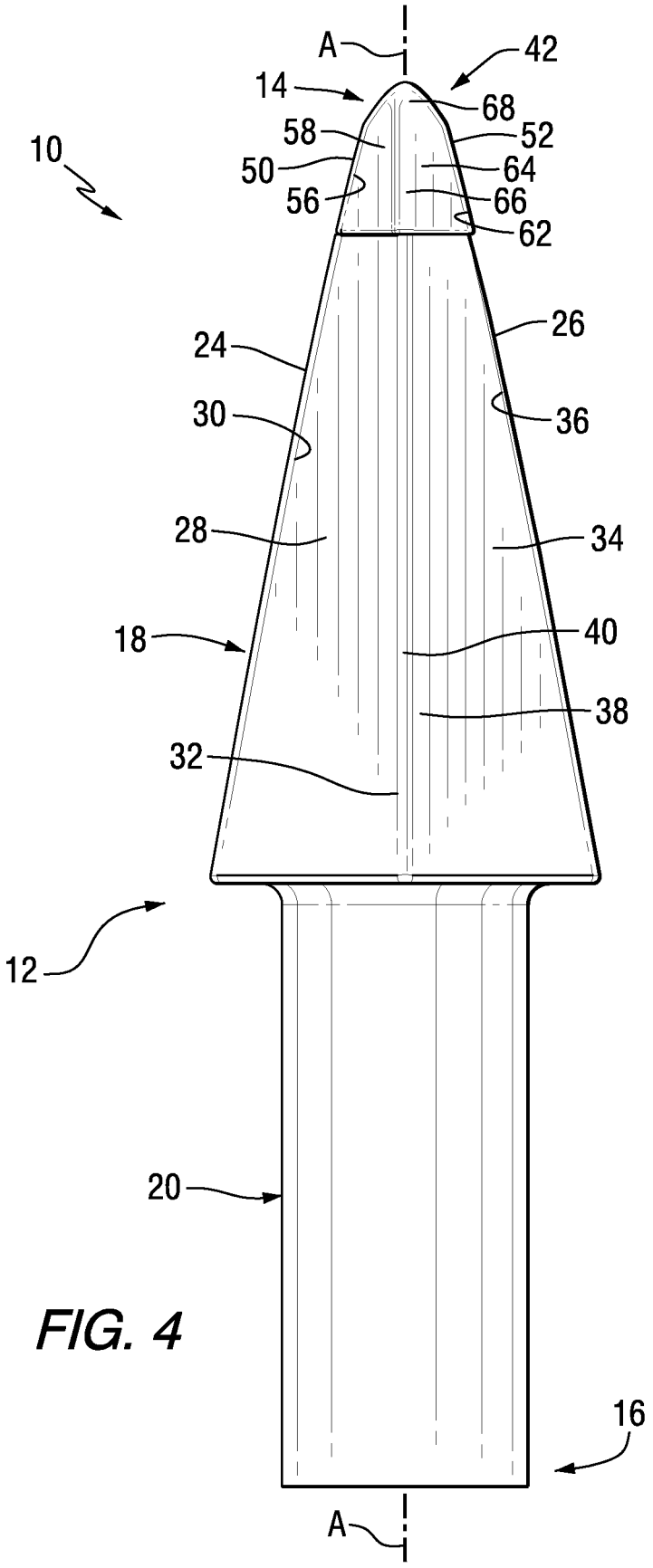
FIG. 4 is a bottom view of the cutting tool shown in FIGS. 1-3, in accordance with an aspect of the invention.

Referring to FIGS. 1-4, there is illustrated a cutting tool, generally designated as reference number 10, in accordance with aspects of the invention. It will be appreciated that the invention has application to various kinds of cutting tools useful in various kinds of cutting operations. Exemplary operations include, without limitation, road planing (or milling), coal mining, concrete cutting, and other kinds of cutting operations wherein a cutting tool with a hard cutting member impinges against a substrate (e.g., earth strata, pavement, asphaltic highway material, concrete, and the like) breaking the substrate into pieces of a variety of sizes including larger-size pieces or chunks and smaller-sized pieces including dust-like particles. In addition, it will be appreciated that the cutting tool 10 of the invention may be manufactured in various sizes and dimensions depending upon the desired application of the tool.

Cutting tool 10 has a central longitudinal axis A-A. Cutting tool 10 includes an elongate cutting tool body, generally designated as 12, which typically is made of, for example, steel. Elongate cutting tool body 12 has an axial forward end 14 and an axial rearward end 16.

Elongate cutting tool body 12 includes a head portion 18 adjacent the axial forward end 14 and a shank portion 20 adjacent the axial rearward end 16. The shank portion 20 may be provided with various shapes and configurations. In one aspect, the shank portion 20 is structured and arranged to be non-rotatable such that the cutting tool 10 is a non-rotatable type tool. For example, the shank portion 20 may be inserted into a bore of a tool holder wherein a retainer ring or other appropriate means may be provided to axially retain the cutting tool and restrict free rotation (not shown). In another aspect, the shank portion 20 may be, for example, rectangular or square, as illustrated by reference number 21(see FIG. 1 dashed lines) and inserted into a similarly configured or shaped bore of a tool holder to prevent rotation of the cutting tool 10.

In accordance with aspects of the invention, the head portion 18 is structured and arranged so as to include a partial frusto-conical portion 22 having a first lateral edge 24 and an opposing second lateral edge 26. In one aspect, the partial frusto-conical portion 22 is continuous from the first lateral edge 24 to the second lateral edge 26.

In accordance with another aspect of the invention, the head portion 18 is structured and arranged so as to also include a first side surface 28 having a first lateral transition edge 30 and an opposing first terminal edge 32. The first lateral transition edge 30 is structured and arranged so as to be adjacent to or adjoined to or connected to the first lateral edge 24 of the partial frusto-conical portion 22. The head portion 18 also includes a second side surface 34 having a second lateral transition edge 36 and an opposing second terminal edge 38. The second lateral transition edge 36 is structured and arranged so as to be adjacent to or adjoined to or connected to the second lateral edge 26 of the partial frusto-conical portion 22.

The head portion 18 is further structured and arranged such that the first terminal edge 32 is adjacent to or adjoined to or connected to the second terminal edge 38 to form a cutting edge 40.

In one aspect, at least a portion of the first side surface 28 and the second side surface 34 are generally planar or flat. In another aspect, at least a portion of the first side surface 28 and/or the second side surface 34 may be coated with a wear resistant material, generally represented by 29 and 35, respectively (see FIG. 2). A suitable wear resistant material may be, for example, KenCast® which is a commercially available product by Kennametal Inc. of Latrobe, Pa., the assignee of the present application.

Advantageously, the described configuration of the head portion 18 improves the overall strength, durability, wear resistance and/or cutting performance of the cutting tool 10. In addition, the invention advantageously provides a wedge effect to assist in separating the substrate and resulting in larger particles thus reducing the smalls produced during the cutting operation.

In accordance with another aspect of the invention, the cutting tool 10 further includes a hard cutting tip, generally designated as reference number 42 adjacent the axial forward end 14. The hard cutting tip 42 may be affixed by, for example, brazing the hard cutting tip 42 to the head portion 18 adjacent the axial forward end 14 of the cutting tool body 12.

In one aspect, the hard cutting tip 42 is structured and arranged so as to include a substrate 44 (see FIG. 1) which may be made from, for example, a hard material such as, for example, cemented (cobalt) tungsten carbide. The hard cutting tip 42 further includes a layer of a superhard material 46 adhered to the substrate 44 (see FIG. 1). The layer of superhard material 46 may include, for example, polycrystalline diamond (PCD) or polycrystalline cubic boron nitride (PCBN).

The layer of superhard material 46 may have a generally constant thickness and can be applied to the substrate 44 by any one of the number of known techniques wherein the superhard material 46 is, for example, bonded to the surface of the substrate 44. For example, one can apply the layer of superhard material 46, e.g. PCD, to the substrate 44 by any one of a number of techniques wherein the layer of superhard material 46 is bonded to the surface of the substrate 44. The following patent documents disclose exemplary compositions of polycrystalline diamond as well as exemplary techniques to apply a layer of polycrystalline diamond to the surface of a substrate: U.S. Pat. No. 4,063,909 to Mitchell, U.S. Pat. No. 4,604,106 to Hall et al., U.S. Pat. No. 4,694,918 to Hall, and U.S. Pat. No. 4,811,801 to Salesky et al.

In accordance with another aspect of the invention, the hard cutting tip 42 is structured and arranged so as to include a partial frusto-conical tip portion 48 having a first lateral tip edge 50 and an opposing second lateral tip edge 52. In one aspect, the partial frusto-conical tip portion 48 is continuous from the first lateral tip edge 50 to the second lateral tip edge 52.

In accordance with another aspect of the invention, the hard cutting tip 42 is structured and arranged so as to also include a first side tip surface 54 having a first lateral transition tip edge 56 and an opposing first terminal tip edge 58. The first lateral transition tip edge 56 is structured and arranged so as to be adjacent to or adjoined to or connected to the first lateral tip edge 50 of the partial frusto-conical tip portion 48. The hard cutting tip 42 also includes a second side tip surface 60 having a second lateral transition tip edge 62 and an opposing second terminal tip edge 64. The second lateral transition tip edge 62 is structured and arranged so as to be adjacent to or adjoined to or connected to the second lateral tip edge 52 of the partial frusto-conical tip portion 48.

The hard cutting tip 42 is further structured and arranged such that the first terminal tip edge 58 is adjacent to or adjoined to or connected to the second terminal tip edge 64 to form a tip cutting edge 66.

In one aspect, at least a portion of the first side tip surface 54 and the second side tip surface 60 are generally planar or flat. In another aspect, the partial frusto-conical portion 22 of the head portion 18 is adjacent to or aligned with or adjoined to or connected to the partial frusto-conical tip portion 48 of the hard cutting tip 42. In another aspect, the first side surface 28 of the head portion 18 is adjacent to or aligned with or adjoined to or connected to the first side tip surface 54 of the hard cutting tip 42. In another aspect, the second side surface 34 of the head portion 18 is adjacent to or aligned with or adjoined to or connected to the second side tip surface 60 of the hard cutting tip 42. In yet another aspect, the cutting edge 40 of the head portion 18 is adjacent to or aligned with or adjoined to or connected to the tip cutting edge 66 of the hard cutting tip 42.

Advantageously, the described configuration of the hard cutting tip 42 improves the overall strength, durability, wear resistance and/or cutting performance of the cutting tool 10. In addition, the invention advantageously provides a wedge effect to assist in separating the substrate and resulting in larger particles thus reducing the smalls produced during the cutting operation.

The hard cutting tip 42 is structured and arranged so as to further include a nose point 68. In one aspect, the nose point 68 is structured and arranged so as to be offset from the central longitudinal axis A-A of the cutting tool body 12. In other words, in one aspect the central longitudinal axis A-A does not pass through the nose point 68.

Advantageously, the described configuration of the nose point 68 being offset from the central longitudinal axis A-A improves the overall strength, durability and/or cutting performance of the cutting tool 10.

Whereas particular aspects of this invention have been described above for purposes of illustration, it will be evident to those skilled in the art that numerous variations of the details of the present invention may be made without departing from the invention as defined in the appended claims.

What is claimed is:

1. A cutting tool for use in impinging earth strata, the cutting tool comprising:

a non-rotatable cutting tool body having a central longitudinal axis, an axial forward end, an axial rearward end, a head portion adjacent the axial forward end and a shank portion adjacent the axial rearward end, the head portion comprising:

a partial frusto-conical portion non-parallel to the central longitudinal axis and having a first lateral edge and a second lateral edge;

a first side surface having a first lateral transition edge and a first terminal edge, wherein the first lateral transition edge is adjoined to the first lateral edge of the partial frusto-conical portion; and a second side surface having a second lateral transition edge and a second terminal edge, wherein the second lateral transition edge is adjoined to the second lateral edge of the partial frusto-conical portion, and wherein the first terminal edge is adjoined to the second terminal edge to form a cutting edge; and a hard cutting tip affixed to the axial forward end of the cutting tool body, wherein the partial frusto-conical portion of the head portion extends from the shank portion to the hard cutting tip.

2. The cutting tool of claim 1, wherein the first side surface is generally flat.

3. The cutting tool of claim 2, wherein the first side surface is coated with a wear resistant material.

4. The cutting tool of claim 1, wherein the second side surface is generally flat.

5. The cutting tool of claim 4, wherein the second side surface is coated with a wear resistant material.

6. The cutting tool of claim 1, wherein the hard cutting tip comprises:

a partial frusto-conical tip portion having a first lateral tip edge and a second lateral tip edge;

a first side tip surface having a first lateral transition tip edge and a first terminal tip edge, wherein the first lateral transition tip edge is adjoined to the first lateral tip edge of the partial frusto-conical tip portion; and a second side tip surface having a second lateral transition tip edge and a second terminal tip edge, wherein the second lateral transition tip edge is adjoined to the second lateral tip edge of the partial frusto-conical tip portion, and wherein the first terminal tip edge is adjoined to the second terminal tip edge to form a tip cutting edge.

7. The cutting tool of claim 6, wherein the first side tip surface is generally flat.

8. The cutting tool of claim 6, wherein the second side tip surface is generally flat.

9. The cutting tool of claim 6, wherein the partial frusto-conical portion of the head portion is adjacent the partial frusto-conical tip portion of the hard cutting tip.

10. The cutting tool of claim 6, wherein the first side surface of the head portion is adjacent the first side tip surface of the hard cutting tip.

11. The cutting tool of claim 6, wherein the second side surface of the head portion is adjacent the second side tip surface of the hard cutting tip.

12. The cutting tool of claim 6, wherein the cutting edge of the head portion is aligned with the tip cutting edge of the hard cutting tip.

13. The cutting tool of claim 6, further comprising the hard cutting tip having a nose point that is offset from the central longitudinal axis of the cutting tool body.

14. The cutting tool of claim 6, wherein the hard cutting tip includes a substrate and a layer of a superhard material adhered to the substrate.

15. The cutting tool of claim 14, wherein the layer of superhard material includes polycrystalline diamond (PCD) or polycrystalline cubic boron nitride (PcBN).

* * * * *